US006221184B1

(12) United States Patent
Bonnevie

(10) Patent No.: US 6,221,184 B1
(45) **Date of Patent: *Apr. 24, 2001**

(54) PROCESS OF THE PRODUCTION OF HIGH-CARBON CAST STEELS INTENDED FOR WEARING PARTS

(75) Inventor: Michel Bonnevie, Bovesse (BE)

(73) Assignee: Magotteaux International S.A., Vaux-Sous-Chevremont (BE)

( * ) Notice: Subject to any disclaimer, the term of this patent is extended or adjusted under 35 U.S.C. 154(b) by 0 days.

This patent is subject to a terminal disclaimer.

(21) Appl. No.: 09/233,208

(22) Filed: Jan. 19, 1999

(30) Foreign Application Priority Data

Jan. 19, 1998 (BE) ..... 09800038

(51) Int. Cl.[7] ..... C21D 6/00
(52) U.S. Cl. ..... 148/548; 148/540
(58) Field of Search ..... 148/540, 548, 148/321, 333; 164/477

(56) References Cited

U.S. PATENT DOCUMENTS 5,855,701 * 1/1999 Bonnevie ..... 148/545

FOREIGN PATENT DOCUMENTS 2456137 8/1976 (DE) .
0120748A1 10/1984 (EP) .
WO95/28506 10/1995 (WO) .

* cited by examiner

*Primary Examiner*—Deborah Yee
(74) *Attorney, Agent, or Firm*—Jacobson, Price, Holman & Stern, PLLC

(57) ABSTRACT

The invention relates to a process for producing cast wearing parts of high-carbon alloy steels having the composition expressed in weight % of:

| | |
|---|---|
| carbon | 0.6 to 2% |
| manganese | 0.5 to 6% |
| chromium | 1 to 6% |
| silicon | 0.4 to 1.5% |

the balance being iron with the usual impurity contents, showing as structure selected from the group consisting of:

a non-equilibrium structure of fine pearlite, containing between 1 and 1.5% by weight of carbon with a hardness lying between 47 and 54 RC;

a high carbon austenitic structure with a hardness lying between 15 and 30 RC;

a high carbon martensitic structure with a hardness lying between 60 and 65 RC, comprising the steps of subjecting steel of the indicated composition, after casting and complete solidification, to a cooling from a temperature of at least 900° C. at a cooling rate lying between 7.5 and 1.0° C./sec down to 500° C. and a cooling rate lying between 2° C. and 0.4° C./sec from 500° C. to room temperature.

14 Claims, 3 Drawing Sheets

PROCESS OF THE PRODUCTION OF HIGH-CARBON CAST STEELS INTENDED FOR WEARING PARTS

FIELD OF THE INVENTION

The present invention relates to a process for the production of high-carbon cast steels which are more particularly intended for the manufacture of wearing parts, especially grinding media such as balls.

BACKGROUND OF THE INVENTION

In the mining industry, it is necessary to release potentially valuable minerals from their rock gangue for the purpose of concentrating them and extracting them.

In order to achieve this release, the ore must be crushed and finely ground.

In the grinding step alone, it may be estimated that 750,000 to 1 million tonnes of grinding media, in the form of spherical balls or cylpebs (frustoconical or cylindrical pebbles), are consumed annually in the world.

In grinding media, the following materials are mainly encountered:

1) low-alloy martensitic steels (0.7 to 1% carbon and alloy elements less than 1%) shaped by rolling or forging and then heat-treated in order to obtain a surface hardness of 60–65 RC;
2) chromium-alloy martensitic cast iron (1.7 to 3.5% carbon and 9 to 30% chromium) shaped by casting and heat-treated in order to obtain a hardness of 60 to 68 RC throughout the cross-section;
3) low-alloy pearlitic white cast irons (3 to 4.2% carbon and alloy elements less than 2%) not treated and having a hardness of 45 to 55 RC, obtained by casting.

Each of the current solutions has drawbacks which are specific to each of them:

- for forged martensitic steels, the capital costs for forging or rolling machines, the heat-treatment plants and the energy consumptions are high;
- as regards chromium-alloy cast irons, there are additional costs related to the alloying elements (mainly chromium) and to the heat treatments;
- finally, for low-alloy pearlitic white cast irons, the manufacturing costs are generally quite low but the performance characteristics in terms of wear resistance are markedly inferior to the previous solutions. In addition, only grinding media of a size less than 60 mm are generally produced industrially.

More particularly, in the case of ores where the gangues are highly abrasive (for example: gold ore, copper ore, etc.), the current solutions are not entirely satisfactory for the users, since the contribution of the products and materials subjected to wear (balls and linings) remains large in the production costs of these potentially valuable metals.

SUMMARY OF THE INVENTION

The object of the invention is to provide a process for the production of cast steels having improved properties and most especially to remedy the drawbacks and shortcomings of the solutions in the prior art for wearing parts (in particular the grinding media), the composition, the shaping by casting and the post-casting cooling conditions of which make it possible to obtain a wear resistance (especially under very abrasive conditions) which is comparable to that of forged martensitic steels and chromium martensitic cast irons, but with a markedly lower cost, and is markedly superior to pearlitic cast irons for a comparable cost.

Other objects and advantages of the invention will appear to those skilled in the art on reading the following description of the characteristic elements of the invention and of particular embodiments thereof.

In the process of the invention, high-carbon steels are used having a composition expressed in % by weight of:

| | |
|---|---|
| carbon | 0.6 to 2% |
| manganese | 0.5 to 6% |
| chromium | 1 to 6% |
| silicon | 0.4 to 1.5% |

the balance being iron, with the usual impurity contents, in that they have non-equilibrium structures obtained directly after solidification.

Depending on the chemical composition and the cooling conditions, the structures of these steels may consist of:

- a non-equilibrium structure of fine pearlite, containing between 1 and 1.5% by weight of carbon with a hardness lying between 47 and 54 RC;
- a high carbon austenitic structure with a hardness lying between 15 and 30 RC;
- a high carbon martensitic structure with a hardness lying between 60 and 65 RC.

Particularly preferably, the carbon contents are:

- between 1.3 and 1.7% as regards the steels consisting of fine pearlite;
- between 1 and 1.6% as regards the steels consisting of austenite;
- between 0.6 and 1% as regards the steels consisting of martensite.

According to the invention, steels of the indicated composition are subjected, after casting and complete solidification, to a cooling from a temperature of at least 900° C. at a cooling rate lying between 7.5 and 1.0° C./sec down to 500° C. and a cooling rate lying between 2° C. and 0.4° C./sec from 500° C. to room temperature.

As regards the non-equilibrium pearlitic structures, specific compositions have proved to be particularly useful for the manufacture of grinding media, in particular balls having a diameter of 100–125 mm, wherein the alloy composition of the steel is:

| | |
|---|---|
| carbon | of the order of 1.3 to 1.7% |
| manganese | of the order of 3 to 4% |
| chromium | of the order of 3 to 3.5% |
| silicon | of the order of 0.4 to 1% |

and for the manufacture of grinding media, in particular balls having a diameter of 30–90 mm, wherein the alloy composition of the steel is:

| | |
|---|---|
| carbon | of the order of 1.3 to 1.7% |
| manganese | of the order of 0.3 to 2.5% |
| chromium | of the order of 1.5 to 3% |
| silicon | of the order of 0.4 to 1%. |

As regards the non-equilibrium austenitic structures, specific compositions have proved to be particularly useful for the manufacture of grinding media, in particular balls having a diameter of 100–125 mm, wherein the alloy composition of the steel is:

| | |
|---|---|
| carbon | of the order of 1 to 1.6% |
| manganese | of the order of 4.4 to 5% |
| chromium | of the order of 3.5 to 4% |
| silicon | of the order of 0.4 to 1% |

and for the manufacture of grinding media, in particular balls having a diameter of 25–90 mm, wherein the alloy composition of the steel is:

| | |
|---|---|
| carbon | of the order of 1 to 1.6% |
| manganese | of the order of 2.6 to 4.1% |
| chromium | of the order of 2.5 to 3.5% |
| silicon | of the order of 0.4 to 1%. |

As regards the non-equilibrium martensitic structures, specific compositions have proved to be particularly useful for the manufacture of grinding media, in particular balls having a diameter of 60–125 mm, wherein the alloy composition of the steel is:

| | |
|---|---|
| carbon | of the order of 0.6 to 1% |
| manganese | of the order of 1.1 to 1.3% |
| chromium | of the order of 3 to 3.5% |
| silicon | of the order of 0.4 to 1% |

and for the manufacture of grinding media, in particular balls having a diameter of 30–60 mm, wherein the alloy composition of the steel is:

| | |
|---|---|
| carbon | of the order of 0.6 to 1% |
| manganese | of the order of 1.3 to 1.6% |
| chromium | of the order of 2.5 to 3% |
| silicon | of the order of 0.4 to 1%. |

These various alloys were evaluated using the same procedure and each proved to be particularly useful depending on the levels and types of stress that are encountered in grinding in the mining industry.

The casting operation causes the shaping of the wearing pieces, and more particularly the grinding media, directly and it can be performed using any of the conventional casting techniques known in founding (especially die casting).

The non-equilibrium structures are obtained by extraction (knock-out) of the still hot casting from the casting mould and by adapting the chemical composition to the mass of the casting and to the rate of cooling (natural or preferably accelerated cooling) which follows extraction from the mould.

DETAILED DESCRIPTION OF PREFERRED EMBODIMENTS

1. Structure Consisting of Non-equilibrium Pearlite

Examples 1 to 4

In all the examples, a steel composition is employed that contains 1.5% of carbon, 3% of chromium, 0.8% of silicon and a variable manganese content, the balance being iron with the usual impurity contents.

The specific manganese and chromium contents, expressed in weight % are given in various examples, in Table I, for various ball sizes.

TABLE I

| Example No. | Ball diameter (mm) | % Mn |
|---|---|---|
| 1 | 100 | 3 |
| 2 | 100 | 1.9 |
| 3 | 70 | 1.5 |
| 4 | 70 | 0.8 |

After complete solidification, the casting is extracted from its mould at a temperature as high as possible but compatible with easy handling, preferably greater than 900° C.

The casting is then cooled uniformly at a well-defined rate depending on its mass.

This controlled cooling is maintained down to a temperature of 500° C., after which the nature of the cooling is immaterial.

The average cooling rates expressed in ° C./s between the temperatures of 1000° C. and 500° C. are given in Table II for the two examples mentioned above.

TABLE II

| Example No. | Ball diameter (mm) | Average cooling rate (° C./s) |
|---|---|---|
| 1 | 100 | 1.15 |
| 2 | 100 | 1.3 |
| 3 | 70 | 1.5 |
| 4 | 70 | 1.65 |

The main advantages of this heat treatment are that it makes it possible to obtain the non-equilibrium fine pearlitic structure more easily and that advantage may be taken of the residual heat of the casting after it has been cast, therefore the production costs may be reduced.

Figure 1:
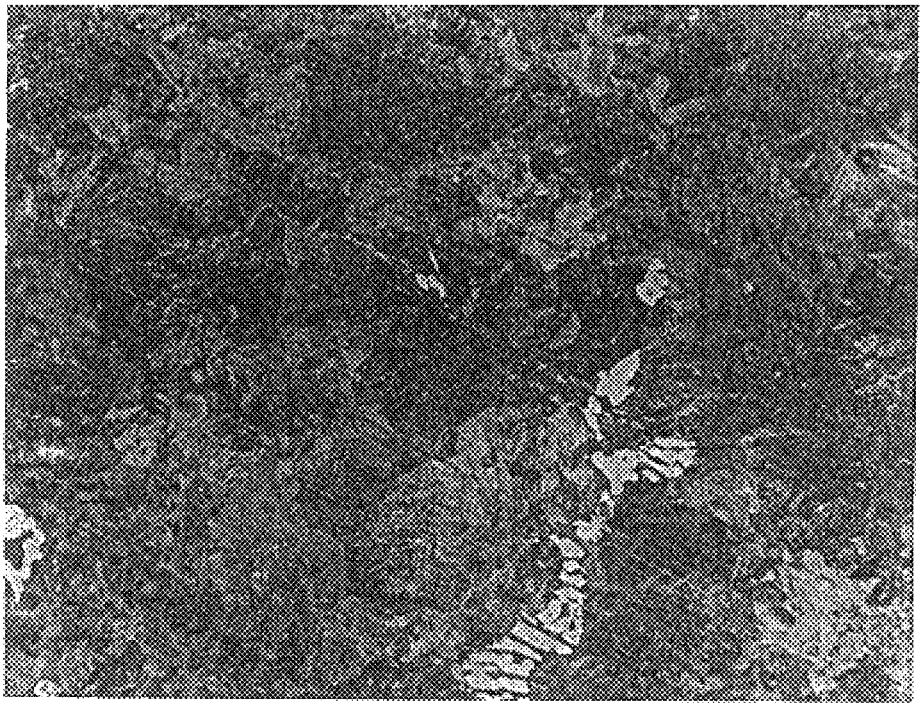
FIG. 1 is a micro-graph of a 100 mm ball showing a structure consisting of non-equilibrium pearlite (400× magnification).
Figure 2:
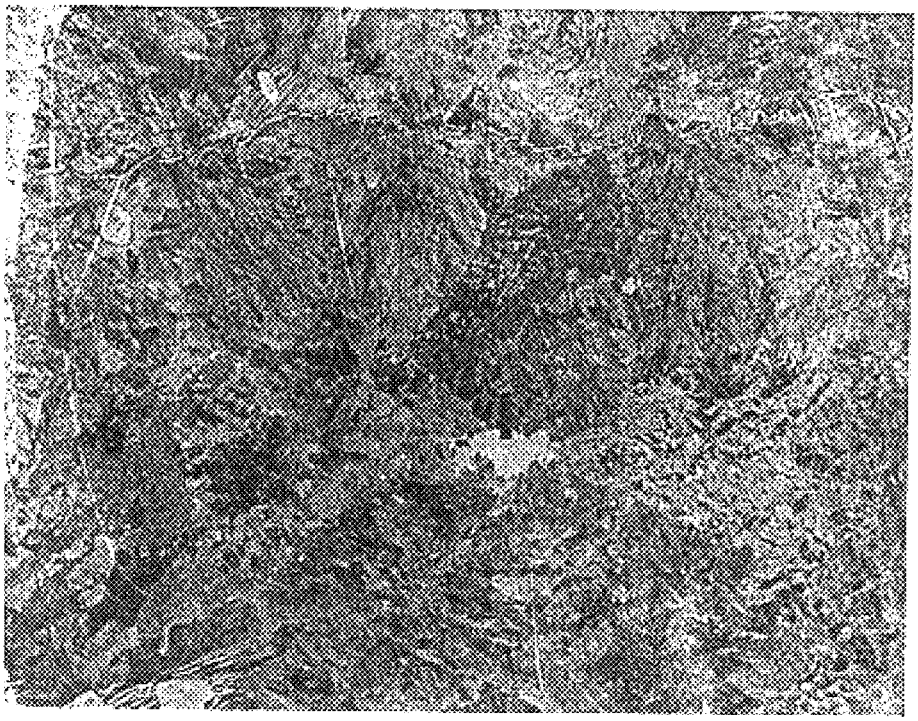
FIG. 2 is a micro-graph of a 70 mm ball showing a structure consisting of non-equilibrium pearlite (400× magnification).

The micrographs of the appended FIGS. 1 and 2 show the steel structures obtained according to the invention.

FIG. 1, with a magnification of 400, shows the micrograph of a 100 mm ball whose chemical composition, expressed in weight %, is:

1.5% carbon
1.9% manganese
3.0% chromium
0.8% silicon.

After knock-out, this casting was cooled from a temperature of 1000° C. down to room temperature at an average rate of 1.30° C./s.

The measured Rockwell hardness is 51 RC. The structure is composed of fine pearlite, of 6 to 8% cementite and of less than 10% martensite.

FIG. 2, of 400 magnification, is the micrograph of a 70 mm ball having as chemical composition, expressed in weight %:

1.5% carbon 1.5% manganese 3.0% chromium 0.8% silicon.

After knock-out, this casting was cooled from a temperature of 1000° C. at an average cooling rate of 1.50° C./sec down to room temperature.

The measured Rockwell hardness is 52 RC. The structure is composed of fine pearlite, of 5 to 7% cementite and of 5 to 7% martensite.

The grinding media or grinding balls whose micrographs are shown in FIGS. 1 and 2 were subjected to wearing tests in order to check their behaviour and their properties in an industrial environment.

The wear resistance of the alloy of the invention was thus able to be evaluated using the technique of marked-ball testing. This technique consists in introducing into an industrial mill a defined quantity of balls manufactured from the alloy according to the invention, these being beforehand set to the same weight and identified by drill-holes conjointly with balls of the same weight, which are manufactured from one or various known alloys of the prior art. After a defined operating period, the mill is stopped and the marked balls within the charge are sought. The balls are weighed and the difference in weight enables the performance characteristics of the various alloys tested to be compared. These tests are repeated several times in order to obtain a statistically valid value.

A first test was carried out in a mill on a particularly abrasive ore—it contains more than 70% of quartz. 100 mm diameter balls were monitored every week for 5 weeks. The reference ball, made of martensitic chromium-alloy cast iron, was worn away from an initial weight of 4.600 kg to 2.800 kg. The relative wear resistances of the various grades of alloy are summarised below:

64 RC martensitic cast iron with 12% chromium: 1×

51 RC steel of the invention: 0.98×

Similar tests were carried out in other mills where the treated ore was also highly abrasive, but in which the impact conditions related to the operating conditions of the mill were different.

The results obtained with balls manufactured from the alloy described in the invention were very similar (0.9 to 1.1 times better) to those obtained using the chromium cast iron.

These performance characteristics of resistance to abrasive wear of the non-equilibrium pearlitic alloy according to the invention make it possible to reduce substantially the grinding-related costs for the user.

Indeed, the simplification of the manufacturing processes, the reduction in the capital and operating costs and the reduction in the alloy elements compared to chromium cast irons enable a more economic production cost to be obtained.

2. Structure Consisting of Non-equilibrium Austenite

In all the examples, a steel composition was employed that contains 1.3% of carbon, 4% of chromium and 0.8% of silicon, the balance being iron with the usual impurity contents.

The specific manganese contents and the rates of cooling between 1000° C. and 500° C. are given in various examples in the table for various ball sizes.

TABLE III

| Ball diameter (mm) | % Mn | Average cooling rate between 1000 and 500° C. (° C./s) | Average cooling rate between 500° C. and room temperature (° C./s) |
|---|---|---|---|
| 80 | 5.0 | 1.89 | 0.5 |
| 60 | 3.5 | 2.5 | 1.75 |
| 40 | 3 | 4.1 | 1.2 |

After complete solidification, the casting is extracted from its mould at a temperature as high as possible but compatible with easy handling, preferably greater than 900° C.

The casting is then cooled uniformly at a well-defined rate depending on its mass.

The controlled cooling is maintained down to a temperature close to room temperature and less than 1000° C.

The main advantages of this heat treatment are to obtain more easily, and for the least cost, a non-equilibrium austenitic structure and to take advantage of the residual heat of the casting after it has been cast.

Figure 3:
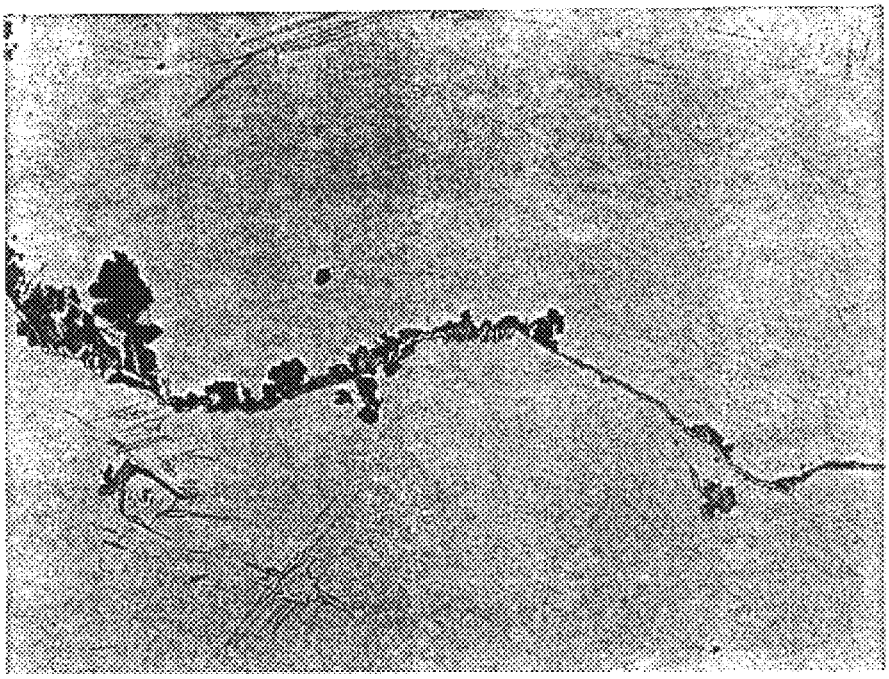
FIG. 3 is a micro-graph of a 60 mm ball showing a structure consisting of non-equilibrium austenitic (400× magnification).
Figure 4:
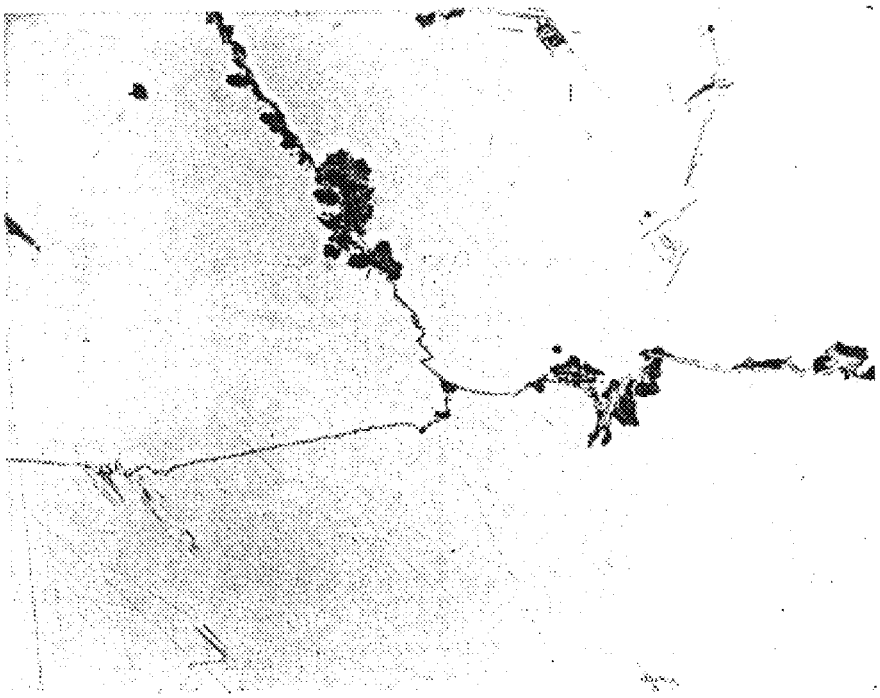
FIG. 4 is a micro-graph of a 40 mm ball showing a structure consisting of non-equilibrium austenitic (400× magnification).

The micrographs of the appended FIGS. 3 and 4 show the steel structure obtained according to the invention.

FIG. 3, of 400×magnification, shows the micrograph of a 60 mm ball whose composition, expressed in weight %, is:

1.3% carbon 3.5% manganese 4.0% chromium 0.8% silicon.

After knock-out, the casting was cooled from a temperature of 1000° C. down to a temperature of 500° C. at an average rate of 2.5° C./sec, and then at an average rate of 0.75° C./s from 500° C. to room temperature.

The measured Rockwell hardness is 29 RC. The structure is composed of non-equilibrium austenite, of 5 to 7% of pearlite, in islands or along the grain boundaries, and of approximately 5% of carbide.

FIG. 4, of 400×magnification, is the micro graph of a 40 mm ball having as chemical composition, expressed in weight %:

1.3% carbon 3.0% manganese 4.0% chromium 0.8% silicon.

After knock-out, this casting was cooled from 1000° C. at an average cooling rate of 4.1° C./sec down to 500° C. and at 1.2° C./sec from 500° C. to room temperature.

The measured Rockwell hardness is 25 RC. The structure is composed of non-equilibrium austenite, of 2–3% of pearlite and approximately 5% of carbide.

In order to evaluate the performance characteristics of a grinding medium manufactured from the alloy of the invention, we have also used the technique of marked-ball industrial testing described above.

A first test was carried out in a mill for grinding copper and zinc sulphide ore containing approximately 11% of quartz.

80 mm balls were checked after 447 and 1061 hours of operation.

The relative wear resistance of the various grades of alloy is summarised below:

65 RC martensitic forged steel—reference=1

67 RC martensitic 12% chromium cast iron—1.71 times better than the forged steel.

28 RC steel of the invention with an austenitic structure—1.33 times better than the forged steel.

A second test was carried out in a mill for regrinding moderately abrasive nickel sulphide ore containing approximately 12% of quartz.

40 mm balls were compared with respect to their wear:

65 RC martensitic forged steel—reference=1

25 RC steel of the invention with an austenitic structure—1.15 times better than the forged steel 67 RC martensitic chromium cast iron—1.33 times better than the forged steel.

The wear-resistance performance characteristics of this austenitic alloy may be explained by a combination of very easy surface hardening by work hardening combined with a greater ductility of the interior of the ball (thereby facilitating its resistance to the well-known impacts).

The combination of these wear and impact-resistance characteristics, the simplification of the manufacturing process and the reduction of the alloy elements with respect to the chromium cast irons enables, in certain well-chosen cases, a solution to be obtained which gives a cost of utilisation of grinding media that is more economic compared to the other possibilities envisaged.

3. Structure Consisting of As-cast Martensite

In all the examples, a steel composition is employed which contains 0.7% of carbon, 3% of chromium and 0.8% of silicon, the manganese being variable and the balance being iron with the usual impurity contents.

The specific manganese contents and the rates of cooling are given in various examples in the table for various ball sizes.

TABLE IV

| Ball diameter (mm) | % Mn | Average cooling rate between 1000 and 500° C. (° C./s) | Average cooling rate between 500° C. and room temperature (° C./s) |
|---|---|---|---|
| 40 | 1.2 | 4.1 | 1.2 |
| 60 | 1.3 | 2.5 | 0.75 |

After complete solidification, the casting is extracted from its mould at a temperature as high as possible but compatible with easy handling, preferably greater than 900° C.

The casting is then cooled uniformly at a well-defined rate depending on its mass.

The controlled cooling is maintained down to a temperature close to room temperature.

The main advantages of this heat treatment are to obtain a martensitic structure easily and for the least cost and to take advantage of the residual heat of the casting after it has been cast.

Figure 5:
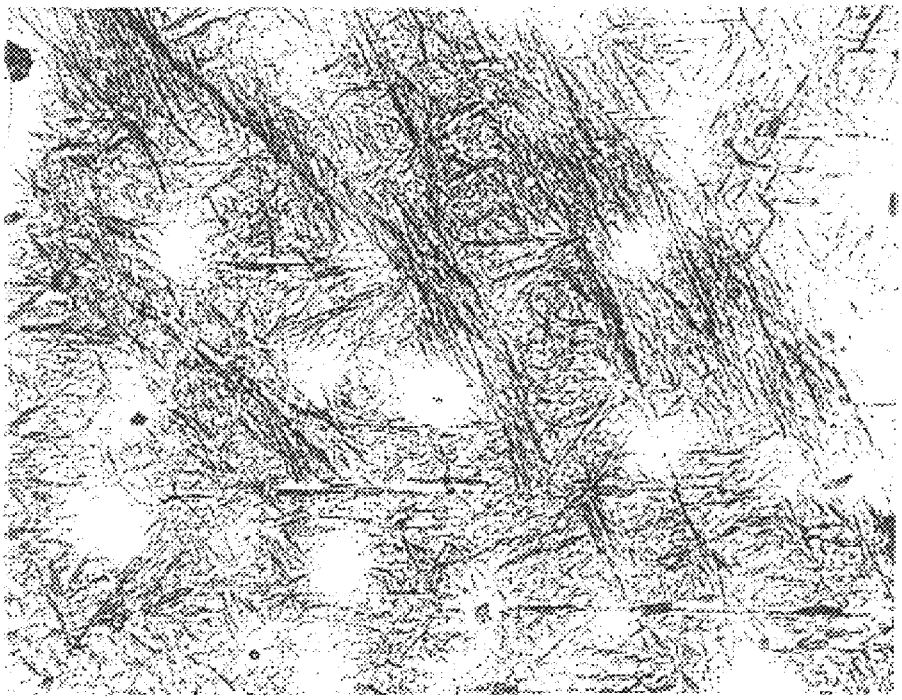
FIG. 5 is a micro-graph of a 60 mm ball showing a structure consisting of non-equilibrium martensitic (400× magnification).
Figure 6:
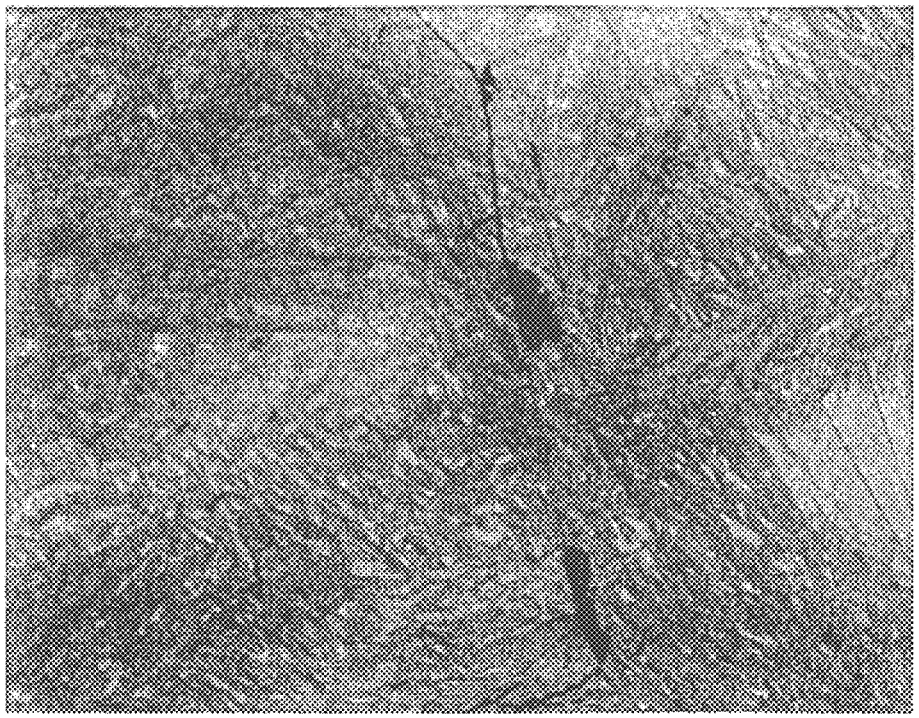
FIG. 6 is a micro-graph of a 40 mm ball showing a structure consisting of non-equilibrium martensitic (1000× magnification).

The micrographs of the appended FIGS. 5 and 6 show the steel structure obtained according to the invention.

FIG. 5, of 400×magnification, shows the micrograph of a 60 mm ball whose composition, expressed in weight %, is:

0.7% carbon 1.3% manganese 3.0% chromium 0.8% silicon.

After knock-out, this casting was cooled from 1000° C. at an average cooling rate of 2.5° C./sec down to 500° C. and at 1.2° C./sec from 500° C. to room temperature.

The measured Rockwell hardness is 64.1 RC. The structure is composed of martensite, of approximately 21M residual austenite, of less than 3% pearlite and of sparse carbides at the grain boundaries.

FIG. 6, of 1000× magnification, is the micrograph of a 40 mm ball having as chemical composition, expressed in weight %:

0.7% carbon 1.25% manganese 3.0% chromium 0.8% silicon.

After knock-out, this casting was cooled from 1000° C. at an average cooling rate of 4.1° C./sec down to 500° C. and then at 0.75° C./sec down to room temperature.

The measured Rockwell hardness is 64.2 RC. The structure is composed of martensite and of residual austenite (approximately 20%).

In order to evaluate the performance characteristics of a grinding medium manufactured from the alloy of the invention, we have also used the technique of marked-ball industrial testing described above.

A first test was carried out in a mill for grinding abrasive copper ore containing approximately 14% of quartz.

40 mm balls were tested after 390 and 1200 hours of operation.

The relative wear resistance of the various grades of alloy is summarised below:

Pearlitic white cast iron: 54 RC—reference=1

Steel of the invention with a martensitic structure—1.65 times better than the pearlitic white cast iron.

A second test was carried out in a mill for grinding copper ore containing 11 to 30% of quartz.

60 mm balls were tested after 650, 1200 and 1650 hours of operation.

The relative wear resistance of the various grades of alloy is summarised below:

Martensitic forged steel: 65 RC—reference=1

Steel of the invention with a martensitic structure: 64 RC—equivalent to the forged steel Martensitic chromium cast iron: 67 RC—1.40 times better than forged cast iron.

TABLE V shows how the percentage of manganese and chromium may be selected for pearlite, austenitic and martensitic steels respectively for various grinding ball diameters.

| | % Manganese | % Chromium |
|---|---|---|
| Pearlite Steel diameter (mm) | | |
| 30 | 0.3 | 1.5 |
| 40 | 0.8 | 1.5 |
| 50 | 1.1 | 2 |
| 60 | 1.6 | 2 |
| 70 | 1.6 | 2.8 |
| 80 | 2.1 | 2.8 |
| 90 | 2.5 | 3 |
| 100 | 3.0 | 3 |
| 125 | 4.0 | 3.5 |
| Austenitic Steel diameter (mm) | | |
| 25 | 2.6 | 2.5 |
| 30 | 2.9 | 2.5 |
| 40 | 3.1 | 2.5 |
| 50 | 3.0 | 3 |
| 60 | 3.5 | 3 |
| 70 | 3.7 | 3 |
| 80 | 3.7 | 3.5 |
| 90 | 4.1 | 3.5 |
| 100 | 4.4 | 3.5 |
| 125 | 4.9 | 4 |
| Martensitic Steel diameter (mm) | | |
| 30 | 1.6 | 2.5 |
| 40 | 1.6 | 2.5 |
| 50 | 1.7 | 2.5 |

TABLE V-continued shows how the percentage of manganese and chromium may be selected for pearlite, austenitic and martensitic steels respectively for various grinding ball diameters.

| | % Manganese | % Chromium |
|---|---|---|
| 60 | 1.3 | 3 |
| 70 | 1.3 | 3 |
| 80 | 1.4 | 3 |
| 90 | 1.0 | 3.5 |
| 100 | 1.0 | 3.5 |
| 125 | 1.1 | 3.5 |

I claim:

1. A process for producing cast wearing parts of high-carbon alloy steels having the composition expressed in weight % of:

| | |
|---|---|
| carbon | 0.6 to 2% |
| manganese | 0.5 to 6% |
| chromium | 1 to 6% |
| silicon | 0.4 to 1.5% |

the balance being iron with the usual impurity contents, showing as structure selected from the group consisting of:

a non-equilibrium structure of fine pearlite, containing between 1 and 1.5% by weight of carbon with a hardness lying between 47 and 54 RC; non-equilibrium.

a high non-equilibrium carbon austenitic structure with a hardness lying between 15 and 30 RC; non-equilibrium a high carbon martensitic structure with a hardness lying between 60 and 65 RC, comprising the steps of subjecting steel of the indicated composition, after casting and complete solidification, to a cooling from a temperature of at least 900° C. at a cooling rate lying between 7.5 and 1.0° C./sec down to 500° C. and a cooling rate lying between 2° C. and 0.4° C./sec from 500° C. to room temperature.

2. A process according to claim 1, wherein said structures of fine pearlite, of austenite or of martensite are obtained by knocking out the still-hot casting from the casting mould, the chemical composition of the steel being adapted to the mass of the casting and to the cooling rate that follows extraction from the mould.

3. A process according to claim 1, wherein the carbon content of the steel lies between 1.3 and 1.7% in order to achieve a non-equilibrium fine-pearlite structure.

4. A process according to claim 1, wherein the carbon content of the steel is 1.5% in order to achieve a non-equilibrium fine-pearlite structure.

5. A process according to claim 1 for obtaining grinding media having a diameter of 100–125 mm, wherein the alloy composition of the steel is:

| | |
|---|---|
| carbon | 1.3% to 1.7% |
| manganese | 3 to 4% |
| chromium | 3 to 3.5% |
| silicon | 0.4 to 1%. |

6. A process according to claim 1 for obtaining grinding media having a diameter of 30–90 mm, wherein the alloy composition of the steel is:

| | |
|---|---|
| carbon | 1.3% to 1.7% |
| manganese | 0.3 to 2.5% |
| chromium | 1.5 to 3% |
| silicon | 0.4 to 1%. |

7. A process according to claim 1, wherein the carbon content of the steel lies between 1 and 1.6% in order to achieve an austenitic structure, obtained directly after solidification.

8. A process according to claim 1, wherein the carbon content of the steel is 1.3% in order to achieve an austenitic structure, obtained directly after solidification.

9. A process according to claim 1 for obtaining grinding media having a diameter of 100–125 mm, wherein the alloy composition of the steel is:

| | |
|---|---|
| carbon | 1 to 1.6% |
| manganese | 4.4 to 5% |
| chromium | 3.5 to 4% |
| silicon | 0.4 to 1%. |

10. A process according to claim 1 for obtaining grinding media having a diameter of 25–90 mm, wherein the alloy composition of the steel is:

| | |
|---|---|
| carbon | 1 to 1.6% |
| manganese | 2.6 to 4.1% |
| chromium | 2.5 to 3.5% |
| silicon | 0.4 to 1%. |

11. A process according to claim 1, wherein the carbon content of the steel lies between 0.6 and 1% in order to achieve a martensitic structure, obtained directly after solidification.

12. A process according to claim 1, wherein the carbon content of the steel is 0.7% in order to achieve a martensitic structure, obtained directly after solidification.

13. A process according to claim 1 for obtaining grinding media having a diameter of 60–125 mm, wherein the alloy composition of the steel is:

| | |
|---|---|
| carbon | 0.6 to 1% |
| manganese | 1.1 to 1.3% |
| chromium | 3 to 3.5% |
| silicon | 0.4 to 1%. |

14. A process according to claim 1 for obtaining grinding media having a diameter of 30–60 mm, wherein the alloy composition of the steel is:

| | |
|---|---|
| carbon | 0.6 to 1% |
| manganese | 1.3 to 1.6% |
| chromium | 2.5 to 3% |
| silicon | 0.4 to 1%. |

* * * * *